US005219687A

United States Patent [19]

Suzuki et al.

[11] Patent Number: 5,219,687

[45] Date of Patent: Jun. 15, 1993

[54] ELECTROPHOTOGRAPHIC LITHOGRAPHIC PRINTING PLATE PRECURSOR AND EDGE FACE TREATMENT

[75] Inventors: Nobuo Suzuki; Junji Nakano; Hiromichi Tachikawa; Yutaka Sakasai, all of Kanagawa, Japan

[73] Assignee: Fuji Photo Film Co., Ltd., Kanagawa, Japan

[21] Appl. No.: 798,583

[22] Filed: Nov. 26, 1991

[30] Foreign Application Priority Data

Nov. 29, 1990 [JP] Japan ..... 2-331414

[51] Int. Cl.[5] ..... G03G 13/26

[52] U.S. Cl. ..... 430/49; 430/302

[58] Field of Search ..... 430/49, 302

[56] References Cited

U.S. PATENT DOCUMENTS 3,455,240 7/1969 Martel et al. ..... 430/49

4,717,583 1/1988 McKissick et al. ..... 430/302

4,985,322 1/1991 Azami et al. ..... 430/49

*Primary Examiner*—John Goodrow

*Attorney, Agent, or Firm*—Sughrue, Mion, Zinn, Macpeak & Seas

[57] ABSTRACT

In an electrophotographic lithographic printing plate precursor comprising a photoconductive layer on an electrically conductive support having a hydrophilic surface thereon which is subjected to a process which comprises formation of a toner image on said photootoconductive layer, and then removal of said photoconductive layer from nonimage portions other than said toner image portion to form a lithographic printing plate, an electrophotographic lithographic printing plate precursor treated with a water-soluble or water-dispersible solid material (edge face treatment) at the edge face thereof and a water-soluble or water-dispersible solid adge face treatment therefor. In a preferred embodiment, the edge face treatmetment is a water-soluble or water-dispersible solid drawing material.

9 Claims, 1 Drawing Sheet

FIGURE
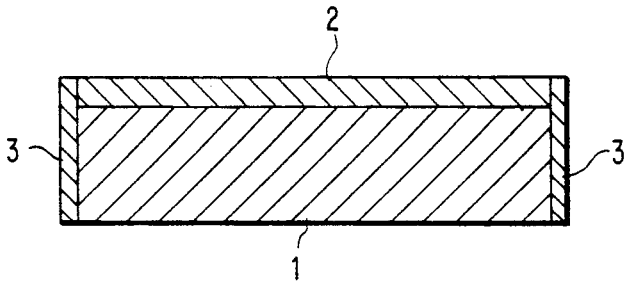

ELECTROPHOTOGRAPHIC LITHOGRAPHIC PRINTING PLATE PRECURSOR AND EDGE FACE TREATMENT

FIELD OF THE INVENTION

The present invention relates to an electrophotographic lithographic printing plate precursor which can be subjected to an electrophotographic toner development process, particularly a reversal development process to obtain a toner image, and then to elution of a light-sensitive layer from nonimage portions other than the toner image portion to prepare a lithographic printing plate. More particularly, the present invention relates to an electrophotographic lithographic printing plate precursor which provides a lithographic printing plate which is not susceptible to printing stain and an edge face treatment for inhibiting stain on the edge face of lithographic printing plate.

BACKGROUND OF THE INVENTION

Presensitized (PS) plates comprising a positive type sensitizing agent containing a diazo compound and a phenolic resin as main components or a negative type sensitizing agent containing an acrylic monomer or prepolymer as a main component have heretofore been used practically as lithographic offset printing plate precursors. However, since all of these printing plate precursors have a low sensitivity, these printing plate precursors are exposed to light with a film original, on which an image has been previously recorded, brought into close contact therewith to form printing plates. On the other hand, with the advances in computer image processing techniques and large capacity data storage and communication techniques, a continuous computer operation including original input, correction, editing, layout and paging has been enabled. With this computer operation, an electronic editing system capable of instantly outputting data to terminal plotters via a high speed communications network or a satellite communications network has been used practically. In particular, such an electronic editing system is in great demand in the field of instantaneous newspaper printing. Furthermore, in the field of printing wherein a printing plate is reproduced as required based on an original stored in the form of a film original, there is a growing tendency to store originals as digital data in very large capacity recording media such as optical discs.

However, little or no direct type printing plate precursors designed to receive data directly from the output of terminal plotters to form a printing plate have been put into practical use. Even in stations where an electronic editing system is operated, data is outputted to a silver salt system photographic film. PS plates are then exposed to light with the silver salt system photographic film brought into contact therewith to form printing plates. One of the reasons for the above described situation is that it is difficult to provide a direct type printing plate precursor having sufficient sensitivity to form a printing plate within a practical period of time using a light source in the output plotter (e.g., a He-Ne laser, a semiconductor laser).

An electrophotographic photoreceptor is a light-sensitive material with a light sensitivity high enough to provide a direct type printing plate. Many electrophotographic printing plate precursors of the type wherein a photoconductive layer in the nonimage portion is removed after the formation of toner image are already known. Examples of such electrophotographic printing plate precursors include those described in JP-B-37-17162, JP-B-38-6961, JP-B-38-7758, JP-B-41-2426 and JP-B-46-39405 (the term "JP-B" as used herein means an "examined Japanese patent publication"), and JP-A-50-19509, JP-A-50-19510, JP-A-52-2437, JP-A-54-145538, JP-A-54-134632, JP-A-55-105254, JP-A-55-153948, JP-A-55-161250, JP-A-57-147656 and JP-A-57-161863 (the term "JP-A" as used herein means an "unexamined published Japanese patent application").

In order to prepare a lithographic printing plate (offset printing plate) using such an electrophotographic lithographic printing plate precursor, the electrophotographic lithographic printing plate precursor which has been imagewise exposed to light is first subjected to a toner development process to form a toner image. These toner development processes have include a known positive development process which comprises development of portions on which electrostatic latent images remain and a reversal development process which comprises development of portions on which electrostatic latent images do not remain. In general, where a light source such as a laser is used to achieve a scanning exposure, a reversal development process is often used. Thereafter, the toner image is fixed. The nonimage portions, other than the toner image portion, are then eluted with an elute so that the hydrophilic substrate is exposed to prepare a lithographic printing plate.

Printing from such a lithographic printing plate gives rise to certain difficulties. When the edge of the printing plate does not come into contact with the surface to be printed, e.g., as in ordinary sheet printers wherein paper sheets with a smaller size than the printing plate are printed, no difficulties occur. However, when a rotary press as used in printing newspapers to print on paper rolls, linear stain are produced on portions of the printed matter corresponding to the edge of the printing plate. This stain occurs markedly when a reversal toner development process is used.

Techniques for inhibiting stain due to the edge of a lithographic printing plate obtained by reversal development of an electrophotographic lithographic printing plate precursor include use of an insulating resin layer on the edge face (side) of the electrophotographic lithographic printing plate precursor (JP-A-63-178240). This approach is based on the idea that print stain due to the lithographic printing plate obtained by reversal development of an electrophotographic lithographic printing plate precursor occurs by toner attaching to the edge face of the electrophotographic lithographic printing plate precursor upon reversal development which leads to the attachment of ink thereto upon printing. Thus, this phenomenon can therefore be inhibited by coating an insulating resin on the edge face of the electrophotographic lithographic printing plate precursor. If such an insulating resin layer is provided on the edge face of the printing plate precursor, little or no toner is attached thereto. However, it was found that since the insulating resin remains on the edge face of the printing plate, ink attaches thereto, causing print stain. In particular, the attachment of the toner can be inhibited by providing an insulating resin layer on the edge face of the printing plate precursor. However, it was found that since the insulating resin layer thus provided has a lipophilic nature itself (i.e., ink receptivity), its presence causes the ink to attach to the edge face of the printing plate precursor, making it impossible to inhibit print stain.

JP-A-2-61654 and JP-A-2-66566 disclose providing a water-soluble high molecular weight layer or a resin layer having a higher solubility in an alkaline solution than the light-sensitive layer on the edge face of the printing plate precursor. These approaches are intended to remove the attached toner together with the resin layer by improving the solubility of the resin layer in an etching solution. However, these approaches are disadvantageous because the resin is coated on the edge face of the printing plate precursor in the form of solution, the coating solution extends to portions other than the edge face, e.g., light-sensitive layer or back surface, inhibiting the formation of images on the light-sensitive layer. It was further found that once toner is attached to and fixed on the portion of the resin layer which had extended to the light-sensitive layer, the toner cannot be removed even using an etching solution. The reason for this phenomenon is unknown. It is postulated that the components in the light-sensitive layer, the resin for edge face treatment and the toner interact in some manner, making the toner insoluble in the etching solution. Thus, the above described approach cannot solve the problem of stain on the edge portion unless it is possible to coat the resin only at the edge portion in the form of solution. Further, if the resin is coated on the edge face of a stack of sheets of printing plates, the coating solution which penetrates into the gap between is the sheets dries and glues the printing plates together, and the printing plates can not be freely used.

Further, JP-A-1-261660 discloses physical removal of a toner attached to the edge face of an electrophotographic printing plate precursor. However, this approach is disadvantageous because the toner is not completely removed and an additional apparatus which adds to the cost of the process is required.

No edge face treatments have been found for completely removing toner attached to the edge face of an electrophotographic lithographic printing plate precursor in an etching solution to inhibit stain on the edge face of a lithographic printing plate produced by a reversal development of an electrophotographic lithographic printing plate precursor. Nor has any means been found for definitely coating such an edge face treatment only on the edge face of the printing plate.

SUMMARY OF THE INVENTION

Therefore an object of the present invention is to provide an edge face treatment which can be surely coated only on the edge face of an electrophotographic lithographic printing plate precursor and which enables toner attached to the edge surface to be removed so that stain on the edge face can be eliminated.

The above object of the present invention will become more apparent from the following detailed description and examples.

The above object of the present invention is accomplished in the following embodiments:

1. An electrophotographic lithographic printing plate precursor comprising a photoconductive layer on an electrically conductive support having a hydropholic surface thereon which is subjected to a process which comprises formation of a toner image on the photoconductive layer, and then removal of the photoconductive layer from the nonimage portions other than the toner image portion to form a lithographic printing plate, wherein an electrophotographic lithographic printing plate precursor treated with a water-soluble or water-dispersible solid material (edge face treatment) at the edge face thereof and a water-soluble or water-dispersible solid adge face treatment therefor.

2. An electrophotographic lithographic printing precursor and an edge face treatment therefor as defined above, wherein the edge face treatment is a water-soluble or water-dispersible solid drawing material.

3. An electrophotographic lithographic printing precursor and an edge face treatment therefor as defined above, wherein the edge face treatment is a water-soluble crayon.

4. An electrophotographic lithographic printing precursor and an edge face treatment therefor as defined above, wherein the edge face treatment is a water-soluble colored pencil.

5. An electrophotographic lithographic printing precursor and an edge face treatment therefor as defined above, wherein the edge face treatment is a water-soluble or water-dispersible chalk.

6. An electrophotographic lithographic printing precursor and an edge face treatment therefor as defined above, wherein the edge face treatment comprises a polyethylene glycol having a number average molecular weight of 1,000 or more.

7. An electrophotographic lithographic printing precursor and an edge face treatment therefor as defined above, wherein the edge face treatment comprises a monoesterified polyethylene glycol of the general formula (I) which is solid at ordinary temperature.

$$R-\underset{\underset{O}{\|}}{C}\leftarrow OCH_2CH_2\rightarrow_n OH \qquad (I)$$

wherein R represents a $C_{12-40}$ alkyl group; and n represents an integer of 4 to 50.

8. An electrophotographic lithographic printing precursor and an edge face treatment therefor as defined above, wherein the edge face treatment comprises a polyethylene glycol having a number average molecular weight of 1,000 or more and a nonionic surface active agent.

9. An electrophotographic lithographic printing precursor and an edge face treatment therefor as defined above, wherein the edge face treatment comprises a water-soluble component made of a water-soluble resin, an oil-soluble component made of a wax which is solid at ordinary temperature, and a surface active agent.

BRIEF DESCRIPTION OF THE DRAWING

The figure is a schematic sectional view of an electrophotographic lithographic printing plate precursor of the present invention, wherein 1 represents an aluminum substrate, 2 represents a photosensitive layer, and 3 represents a coat which has been treated by an edge face treatment.

DETAILED DESCRIPTION OF THE INVENTION

The present invention is further described hereinafter in detail.

As an edge face treatment to be used in the present invention, any water-soluble or water-dispersible solid material which can be coated on the edge face of an electrophotographic lithographic printing plate precursor and which stays solid at ordinary temperature (e.g., 15~30° C.) but can be dissolved or dispersed to leave there upon elution of the nonimage portions of the printing plate precursor can be used.

Examples of such an edge face treatment are described hereinafter.

Examples of such an edge face treatment include water-soluble or water-dispersible solid drawing materials such as a water-soluble crayon, a water-soluble colored pencil and a water-soluble chalk. These drawing materials normally include a water-soluble component made of water-soluble resin, an oil-soluble component made of wax or waxy compound, a coloring agent and a surface active agent. The drawing material to be used in the present invention may or may not contain a coloring agent. If the drawing material contains a coloring agent, this is advantageously since ionfirmation (by color) that the edge treatment has been carried out can be made. Any of the following compounds can be used as such a water-soluble resin:

Examples of natural high molecular compounds as resins include starches such as sweet potato starch, potato starch, tapioca starch, flour starch and corn starch, compounds obtained from algae such as carrageenan, laminarin, seaweed mannan, funorin, Irish moss, agar and sodium alginate, vegetable mucilages such as hibiscus, mannan, quinceseed, pectin, tragacanth gum, karaya gum, xanthine gum, guar been gum, locust been gum, gum arabic, Carob gum and benzoin gum, mucilages obtained by modification of homopolysaccharides such as dextran, glucan and levan or heteropolysaccharides such as succinoglucan and santan gum through microbial fermentation, and proteins such as glue, gelatin, casein and collagen.

Examples of semi-natural (semi-synthetic) resins include propylene glycol .ester alginate, cellulose derivatives such as viscose, methyl cellulose, ethyl cellulose, methyl ethyl cellulose, carboxy methyl cellulose, hydroxypropyl cellulose, hydroxypropyl methyl cellulose, hydroxypropyl ethyl cellulose and hydroxypropyl methyl cellulose phthalate, and processed starch. Examples of processed starches include calcined starch such as white dextrin, yellow dextrin and British gum, enzyme-modified dextrins such as enzyme dextrin and Shardinger dextrin, acid-decomposable starches such as soluble starch, oxidized starches such as dialdehyde starch, alpha starches such as modified alpha starch and unmodified alpha starch, esterified starches such as phosphoric starch, aliphatic starch, sulfuric starch, nitric starch, xanthogenic starch and carbamic starch, etherified starches such as carboxyalkyl starch, hydroxyalkyl starch, sulfoalkyl starch, cyanoethyl starch, allyl starch, benzyl starch, carbamylethyl starch and dialkylamino starch, crosslinked starches such as methylol-crosslinked starch, hydroxyalkyl-crosslinked starch, phosphoric acid-crosslinked starch and dicarboxylic acid-crosslinked starch, and starch grafted copolymers such as starch-polyacrylamide copolymer, starch-polyacrylic acid copolymer, starch-polyvinyl acetate copolymer, starch-polyacrylonitrile copolymer, cationic starch-polyacrylic ester copolymer, cationic starch-vinyl polymer copolymer, starch-polystyrene-maleic acid copolymer and starch-polyethylene oxide copolymer.

Examples of synthetic resins include polyvinyl alcohol, modified polyvinyl alcohols such as partially acetal polyvinyl alcohol, allyl-modified polyvinyl alcohol, polyvinyl methyl ether, polyvinyl ethyl ether and polyvinyl isobutyl ether, polyacrylic acid derivatives and polymethacrylic acid derivatives such as sodium polyacrylate, partially-saponified ester polyacrylate, polymethacrylate and polyacrylamide, polyethylene glycol, polyethylene oxide, polyvinyl pyrrolidone, polyvinyl pyrrolidone-vinyl acetate copolymer, carboxyvinyl polymer, styrol-maleic acid copolymer, and styrol-crotonic acid copolymer.

Examples of waxes or waxy compounds which stay solid at ordinary temperature include paraffin wax, microcrystalline wax, ketone wax, oxidized microcrystalline wax, Japan wax, beeswax, rice wax, candelilla wax, polyethylene wax, wax analogues such as higher aliphatic acids (e.g., myristic acid, palmitic acid, stearic acid and behenic acid) and higher alcohols (e.g., cetyl alcohol, stearyl alcohol, cholesterol and lanolin alcohol), or 1,2-hydroxystearic acid.

Suitable coloring agent which can be used include known inorganic pigments, organic pigments or dyes. Examples of suitable inorganic pigments include titanium oxide, bone black, lamp black, carbon black, ultramarine, prussian blue, cobalt blue, cerulean blue, cobalt green, chromium oxide, cadmium yellow, chrome yellow, barium yellow, strontium yellow, cadmium red, red iron oxide, vermilion, and iron oxide. Examples of appropriate organic pigments include phthalocyanine blue, phthalocyanine green, Hansa Yellow, Orange 2B, alizarin red, and Lake Red. Metal powder pigments such as bronze powder and aluminum powder, and alcohol-soluble azo dyes and spirit-soluble azo dyes insoluble in water as well can also be used. Further, aluminum silicates such as kaolin, clay and bentonite, magnesium silicates such as talc, and extender pigments such as barium sulfate and calcium carbonate can be used.

The surface active agent is used to emulsify the water-soluble component and the oil-soluble component. Examples of surface active agents (emulsifier) for providing O/W type emulsions include nonionic surface active agents with a hydropholic lipophilic balance (HLB) of 8 to 16 such as polyoxyethylene alkyl ether, polyoxyethylene alkyl phenol ether, polyoxyethylene sorbitan aliphatic ester, polyoxyethylene aliphatic ester and glycerin aliphatic ester. These surface active agents can be used alone or in admixture.

Examples of surface active agents for providing W/O type emulsions include nonionic surface active agents with an HLB of 3 to 8 such as sorbitan aliphatic ester (e.g., sorbitan monopalmitate, sorbitan monostearate, sorbitan distearate, sorbitan tristearate), glycerin aliphatic ester (e.g., monoglyceride stearate), polyoxyethylene alkyl ether, polyoxyethylene phenol ether, and polyoxyethylene aliphatic ester. When beeswax is used as the wax, borax can be used. These surface active agents can be used alone or in admixture. These surface active agents preferably stay solid at ordinary temperature.

Other auxiliary agents which can be appropriately used include humectants such as glycerin, ethylene glycol and urea and fillers such as calcium carbonate, talc, atagel, mica and alumina. The amount of these components is not specifically limited so long as a coatable solid is obtained. In particular, the amount may be 1 to 50 wt. % of water-soluble resin, 10 to 80 wt. % of wax, 1 to 5 wt. % of pigment, and 1 to 50 wt. % of emulsifier.

Another form of drawing material is a solid drawing material prepared .from the above described components, excluding the oil-soluble wax, i.e., containing the water-soluble resin or wax, the surface active agent and/or coloring agent. Suitable water-soluble resins or waxes which can be used are a waxy polyethylene glycol having a number average molecular weight of 1,000 or more (more specifically, from 1,000 to 300,000, preferably 3,000 to 100,000) or a number monoesterified polyethylene glycol represented by the general formula (I) which stays solid at ordinary temperature:

$$R-\underset{\underset{O}{\|}}{C}+OCH_2CH_2\rangle_n OH \quad (I)$$

wherein R represents a $C_{12-40}$ (preferably $C_{12-22}$ alkyl group; and n represents 4 to 50 (preferably 8 to 40).

Appropriate surface active agents incorporated in the solid drawing material preferably are a nonionic surface active agent. Examples of suitable nonionic surface active agents include solid compounds such as polyoxyethylene stearyl ether, polyoxyethylene sorbitan distearate and polyoxyethylene sorbitan tristearate.

If the compound represented by the general formula (I) is used, such a surface active agent may or may not be used. Suitable coloring agents which can be used include the above described inorganic pigments, organic pigments or dyes. In order to improve the coatability of the coating solution or the fixability of the coated material, a water-soluble resin may be added to the system. In order to improve the bending strength of the composition, a polyolefin resin may be added to the system. Examples of suitable water-soluble resins which can be used are the above described compounds. Polyethylene, polypropylene, ethylene-vinyl acetate copolymer or the like can be used as the polyolefin resin.

Further, as the edge face treatment, a compound which stays waxy at ordinary temperature of the above described water-soluble resins can be used alone. Preferred examples of such a waxy compound include a polyethylene glycol having a number average molecular weight of 1,000 or more and a monoesterified polyethylene glycol represented by the general formula (I) which stays solid at ordinary temperature.

Particularly effective of the edge face treatments of the present invention are the water-soluble crayon and the water-soluble colored pencil.

Any commercially available product can be used as a water-soluble crayon, water-soluble colored pencil or water-soluble or water-dispersible chalk. The color of the water-soluble solid drawing material is not specifically limited. The water-soluble drawing material has a color such that when coated on the edge face of an electrophotographic lithographic printing plate precursor, it can be recognized as being coated.

Examples of commercially available water-soluble crayons include Wachsmalkreiden 228M10D available from Staedtrer Inc. (Germany), Neocolor-II Aquarelle available from Caran D'ache Inc. (Switzerland), Coldfarber Aquawacks available from Faber Castell Inc. (Germany), and Rakugaki Crayon (Disney Character DGW (1)-16) available from Pentel Co., Ltd. (Japan). Examples of commercially available water-soluble colored pencils include Karat Aquarelp available from Staedtrer Inc., watercolor pencil Prismaloii available from Caran D'ache Inc., watercolor pencil Swan-Stabilo available from Stabilo Inc. (Germany), and watercolor pencil Albrecht Durer Kunsteraquarellstifte und-minen available from Farber-Castell Inc. However, the present invention is not limited to these products.

The edge face treatment of the present invention should be selected such that it is harmless to the etching solution or electrophotographic developer. Substances harmful to the etching solution or electrophotographic developer cannot be definitely specified but this is a precaution for use and routine preliminary testing is all that is needed.

The coating of the edge face treatment of the present invention may be effected on every sheet of the printing plate precursor. Preferably, the coating of the edge face treatment is effected on a stack of sheets (e.g., 1,000 sheets) of the printing plate precursor. In this case, it goes without saying that the coating may be effected with a laminated paper as described in JP-B-57-23259 and JP-A-57-99647 interposed between the stacked sheets of the printing plate precursor. The coated amount of the edge face treatment is not specifically limited but normally is in the range of about 0.01 to about 50 g/m$^2$, preferably 0.1 to 20 g/m$^2$.

The coating of the water-soluble or water-dispersible solid edge face treatment of the present invention on the edge face of an electrophotographic lithographic printing plate precursor can be accomplished by hand to coat the material on the edge face. It may also be accomplished by manually or mechanically operating a roller with an edge face treatment having the same thickness as that of the stack of sheets (e.g., 1,000 sheets) of the printing plate precursor mounted thereon.

Since the edge face treatment of the present invention can be easily coated on the edge face of an electrophotographic lithographic printing plate precursor in the solid state, it is not coated on portions other than the edge face. Therefore, the penetration of the solution into the gap between the light-sensitive materials which is unavoidable with the conventional edge face treatment to be coated in the form of solution (regardless of whether it is an aqueous solution or an organic solvent solution) can be completely avoided. Since the edge face treatment of the present invention is water-soluble or water-dispersible, it can be completely removed by an etching solution (mainly comprising an alkaline aqueous solution), completely inhibiting print stain from subsequently occurring.

The inventors intentionally coated a solid edge face treatment of the present invention on the surface of a light-sensitive material, and then subjected the material to an ordinary development, fixing and etching treatment. As a result, the portions of the light-sensitive material on which the edge face treatment had been coated were completely dissolved away to expose the substrate. On the other hand, the same experiment was carried out by coating the resins as disclosed in the above JP-A-2-61654 and JP-A-2-66566 on the surface of a light-sensitive material in the form of solution. As a result, the portions of the light-sensitive material on which the resins had been coated were not removed after etching.

It was thus found that the coating of such a resin in the form of solution causes a problem that it is impossible for the resin to be coated only on the edge face of the printing plate precursor as well as a problem that the coating solution undergoes some interaction with the light-sensitive material. It is noted that the solid edge face treatment of the present invention provides a solution to these prior art difficulties.

Various supports can be used as an electrically conductive substrate material for the electrophotographic printing plate precursor of the present invention. For example, a synthetic resin sheet with an electrically conductive surface, a solvent-impermeable and electrically conductive paper, and an electrically conductive substrate material with a hydrophilic surface such as an aluminum plate, a zinc plate, a bimetal plate (e.g., a copper-aluminum plate, a copper-stainless steel plate, a chromium-copper plate) or a trimetal plate (e.g., a chromium-copper-aluminum plate, a chromium-lead-iron plate, a chromium-copper-stainless steel plate) can be used. The thickness of such a substrate is preferably in the range of 0.1 to 3 mm, particularly 0.1 to 0.5 mm. Particularly preferred of these substrate materials is an aluminum plate. Suitable aluminum plates for the present invention include a plate of pure aluminum comprising aluminum as the main component or a plate of an aluminum alloy containing a small amount of different element. The composition of such an aluminum plate is not specifically limited. Materials which are heretofore known and commonly used can be appropriately employed in the present invention.

The aluminum plate can be grained and anodically oxidized in any known manner before use. Before graining, the aluminum plate may be optionally degreased with a surface active agent or an alkaline aqueous solution to remove rolling oil therefrom. The graining can be accomplished by mechanically roughening the surface of the material, electrochemically dissolving the surface of the material or chemically and selectively dissolving the surface of the material. Mechanical roughening can be accomplished using any known methods such as a ball grinding method, a brush grinding method, a blast grinding method or a buff grinding method. Electrochemical roughening can be effected in a hydrochloric acid or nitric acid electrolyte with an alternating current or direct current being supplied. The two processes can be used in combination as disclosed in JP-A-54-63902.

The aluminum plate thus roughened is optionally subjected to etching with an alkali or neutralization.

The aluminum plate thus treated is then anodically oxidized. Sulfuric acid, phosphoric acid, oxalic acid, chromic acid or a mixture thereof can be used as an electrolyte in the anodic oxidation. The content and concentration of the electrolyte depend on the type of electrolyte used. The conditions under which the anodic oxidation is effected depend on the type of electrolyte and are not specifically limited. In general, the anodic oxidation is preferably effected with an electrolyte concentration of 1 to 80% by weight at a temperature of 5° to 70° C., a current density of 5 to 60 A/dm$^2$ and a voltage of 1 to 100 V for 10 seconds to 50 minutes. The amount of film obtained by the anodic oxidation is preferably in the range of 0.1 to 10 g/m$^2$, particularly 1 to 6 g/m$^2$.

As described in JP-B-47-5125, an aluminum supported obtained by anodic oxidation of an aluminum plate and then immersing the material in an aqueous solution of a silicate of an alkaline metal can be advantageously used. As .described in U.S. Pat. No. 3,658,662, an aluminum support obtained by electrodepositing a silicate on an aluminum plate can also be effectively used. A treatment with a polyvinylsulfonic acid as described in West German Patent Disclosure No. 1,621,478 can also be advantageously used.

A known electrophotographic light-sensitive layer (photoconductive layer) is then provided on the electrically conductive substrate thus obtained.

Any of the following known compounds can be used as the photoconductive material to be used in the electrophotographic lithographic printing plate precursor of the present invention:

1) Triazole derivatives as described in U.S. Pat. No. 3,112,197;

2) Oxadiazole derivatives as described in U.S. Pat. No. 3,189,447;

3) Imidazole derivatives as described in JP-B-37-16096;

4) Polyarylalkane derivatives as described in U.S. Pat. Nos. 3,615,402, 3,820,989, and 3,542,544, JP-B-45-555, and JP-B-51-10983, and JP-A-51-93224, JP-A-55-108667, JP-A-55-156953, and JP-A-56-36656;

5) Pyrazoline derivatives and pyrazolone derivatives as described in U.S. Pat. Nos. 3,180,729, and 4,278,746, and JP-A-55-88064, JP-A-5588065, JP-A-49-105537, JP-A-55-51086, JP-A-56-80051, JP-A-56-88141, JP-A-57-45545, JP-A-54-112637, and JP-A-55-74546;

6) Phenylenediamine derivatives as described in U.S. Pat. No. 3,615,404, JP-B-51-10105, JP-B-46-3712, JP-B-47-28336, and JP-A-54-83435, JP-A-54-110836, and JP-A-54119925;

7) Arylamine derivatives as described in U.S. Pat. Nos. 3,567,450, 3,180,703, 3,240,597, 3,658,520, 4,232,103, 4,175,961, and 4,012,376, West German Patent (DAS) 1,110,518, JP-B-49-35702, and JP-B-39-27577, and JP-A-55-144250, JP-A-56-119132, and JP-A-56-22437;

8) Amino-substituted chalcone derivatives as described in U.S. Pat. No. 3,526,501;

9) N,N-bicarbazyl derivatives as described in U.S. Pat. No. 3,542,546;

10) Oxazole derivatives as described in U.S. Pat. No. 3,257,203;

11) Styrylanphracene derivatives as described in JP-A-56-46234;

12) Fluorenone derivatives as described in JP-A-54-110837;

13) Hydrazone derivatives as described in U.S. Pat. No. 3,717,462, and JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749, and JP-A-57-104144;

14) Benzidine derivatives as described in U.S. Pat. Nos. 4,047,948, 4,047,949, 4,265,990, 4,273,846, 4,299,897, and 4,306,008; and 15) Stilbene derivatives as described in JP-A-58-190963, JP-A-59-95540, JP-A-59-97148, JP-A-59-195658, and JP-A-62-36674.

In addition to the above described low molecular weight photoconductive compounds, the following high molecular weight compounds can be used:

16) Polyvinylcarbazole and derivatives thereof as described in JP-B-34-10966;

17) Vinyl polymers such as polyvinylpyrene, polyvinylanthracene, poly-2-vinyl-4-(4'-dimethylaminophenyl)-5-phenyloxazole and poly-3-vinyl-N-ethylcarbazole as described in JP-B-43-18674 and JP-B-43-19192;

18) Polymers such as polyacenaphthylene, polyidene, and copolymers of acenaphthylene and styrene as described in JP-B-43-19193;

19) Condensed resins such as pyrene-formaldehyde resin, bromopyrene-formaldehyde resin, and ethylcarbazole-formaldehyde resin as described in JP-B-56-13940; and 20) Various triphenylmethane polymers as described in JP-A-56-90883, and JP-A-56-161550.

For the purpose of improving the sensitivity of the photoconductive unit, providing the desired sensitive wavelength range, or like purposes, various pigments, sensitizing dyes or the like can be used. Examples of these pigments include:

21) Monoazo, bisazo and trisazo pigments as described in U.S. Pat. Nos. 4,436,800, and 4,439,506, JP-A-47-37543, JP-A-58-123541, JP-A-58-192042, JP-A-58-219263, JP-A-59-78356, JP-A-60-179746, JP-A-61-148453, and JP-A-61-238063, and JP-B-60-5941, and JP-B-60-45664;

22) Phthalocyanine pigments such as metallic phthalocyanine pigment and metal-free phthalocyanine as set forth below:

(A) X type, r type and o type metal-free phthalocyanine pigments and derivatives thereof as described in JP-B-44-14106, JP-B-45-30469, JP-B-46-42512, and JP-B-48-34189, JP-A-58-182639, JP-A-62-47054, JP-A-63-55554, JP-A-63-154688, JP-A-63-180962, and JP-A-60-243089, and *J. Chem. Phys.*, Vol. 55, 3178 (1971);

(B) $\alpha$ type, $\beta$ type and $\epsilon$ type copper phthalocyanine pigments and derivatives thereof as described in JP-A-50-38543, JP-A-51-23738, JP-A-51-109841, JP-A-55-59648, JP-A-57-54943, JP-A-57-185044, JP-A-62-121459, JP-A-56-46235, and JP-A-62-141563;

(C) Various titanylphthalocyanine pigments and derivatives thereof as described in JP-A-59-49544, JP-A-59-166959, JP-A-63-116158, JP-A-63-198067, JP-A-62-275272, JP-A-61-67866, JP-A-61-217050, JP-A-59-214034, JP-A-63-364, JP-A-63-365, and JP-A-63-37163;

(D) Vanadylphthalocyanine pigments and derivatives thereof as described in JP-A-63-18361, JP-A-57-146255, JP-A-57-147641, and JP-A-61-28557, and *Appl. Phys. Lett.*, Vol. 38, 445 (1981);

(E) Aluminumphthalocyanine pigments and derivatives thereof as described in JP-A-59-204839, JP-A-57-211149, JP-A-62-163060, JP-A-62-177069, JP-A-63-43155, JP-A-59-214034, and JP-A-57-90058, and *Appl. Phys. Lett.*, Vol. 40, 279 (1982);

(F) Indiumphthalocyanine pigment and derivatives thereof as described in JP-A-61-84655, JP-A-59-44054, JP-A-59-128544, JP-A-60-59355, JP-A-63-261265, JP-A-59-155851, JP-A-63-27562, and JP-A-63-56564;

23) Perylene pigments as described in U.S. Pat. No. 3,371,884;

24) Indigo and thioindigo derivatives as described in British Patent 2,237,680;

25) Quinacridone pigments as described in British Patent 2,237,679;

26) Polycyclic quinone pigments as described in British Patent 2,237,678, and JP-A-59-184348, and JP-A-6228738;

27) Bisbenzimidazole pigments as described in JP-A-47-30331;

28) Squalium salt pigments as described in U.S. Pat. Nos. 4,396,610; and 4,644,082;

29) Azlenium salt pigments as described in JP-A-59-53850, and JP-A-61-212542.

Examples of the above described sensitizing dyes include known compounds as described in *Sensitizer*, page 125, Kodansha, 81987, *Electrophotography*, 12, 9 (1973), and *Organic Synthetic Chemistry*, 24, No. 11, 1010 (1966). Examples of these compounds include:

30) Pyrilium dyes as described in U.S. Pat. Nos. 3,141,770, and 4,283,475, JP-B-48-25658, and JP-A-62-71965;

31) Triarylmethane dyes as described in *Applied Optics Supplement*, 3, 50 (1969), and JP-A-50-39548;

32) Cyanine dyes as described in U.S. Pat. No. 3,597,196; and

33) Styryl dyes as described in JP-A-60-163047, JP-A-59-164588, and JP-A-60-252517.

These compounds can be used alone or in combination. Furthermore, if these electric charge generators are capable of not only generating electric charge but also transporting electric charge, they can be coated in the form of a dispersion in a binder as a basic material to form a photoreceptor. In other words, the use of an organic photoconductive compound (e.g., compounds within the above mentioned groups (1) to (20)) is not necessarily required.

For the purpose of improving sensitivity, the photoconductive layer of the present invention can comprise an electron attractive compound such as trinitrofluorenone, chloranil, and tetracyanoethylene, a compound as described in JP-A-58-65439, JP-A-58-102239, JP-A-58-129439, and JP-A-62-71965, or the like.

The photoconductive compound itself may have film-forming properties in the electrophotographic photoreceptor. If the photoconductive compound does not have film-forming properties, a binder resin can be used. Any resins known in the field of electrophotography can be used as a binder resin to be incorporated in the photoconductive layer in the electrophotographic lithographic printing plate precursor of the present invention. In order to prepare a printing plate from an electrophotographic photoreceptor, it is necessary to ultimately remove the photoconductive layer from the nonimage portions. This process is not specifically limited because it depends on relative relationships such as solubility of the photoconductive layer in the elute and resistance of toner image to the elute. Suitable binder resins which are preferably used include a high molecular weight compound soluble or dispersible in the elute as set forth below.

Specific examples of high molecular weight compounds include copolymers of styrene and maleic anhydride, copolymers of styrene and anhydrous maleic monoalkyl ester, acrylic ester or methacrylic ester such as methacrylic acid-methacrylic ester copolymer, styrene-methacrylic acid-methacrylic ester copolymer, acrylic acid-methacrylic ester copolymer, styrene-acrylic acid-methacrylic ester copolymer, vinyl acetate-crotonic acid copolymer and vinyl acetate-crotonic acid-methacrylic ester copolymer, copolymers of styrene or vinyl acetate with a carboxylic acid-containing monomer or acid anhydride-containing monomer such as acrylic acid, methacrylic acid, itaconic acid, crotonic acid, maleic acid, maleic anhydride and fumaric acid, copolymers comprising a monomer containing methacrylic amide, vinyl pyrrolidone, a phenolic hydroxyl group, a sulfonic acid group, a sulfonamide group, a sulfonimide group or the like, and vinyl acetal resins such as a phenolic resin, partially saponified vinyl acetate resin, xylene resin and polyvinyl butyral.

Among these binder resins, copolymers comprising as copolymeric components a monomer containing an acid anhydride group or a carboxylic acid group, and a phenolic resin exhibit a high charge retention when incorporated in the photoconductive insulating layer in the electrophotographic printing plate precursor and thus may be used with good results.

As a copolymer comprising as a copolymeric component a monomer containing an acid anhydride group, a copolymer of styrene and maleic anhydride is preferably used. This copolymer may be used in the form of the half ester thereof. As a copolymer comprising as a copolymeric component a monomer containing a carboxylic acid group, a binary or higher copolymer of acrylic acid or methacrylic acid with an acrylic or methacrylic alkyl ester, aryl ester or aralkyl ester can be advantageously. Another preferred example of such a copolymer is a vinyl acetate-crotonic acid copolymer or terpolymer of vinyl acetate, vinyl ester of $C_{2-18}$ carboxylic acid and crotonic acid. Particularly preferred among phenolic resins is a novolak resin obtained by condensation of phenol, o-cresol, m-cresol or p-cresol with formaldehyde or acetaldehyde under acid conditions.

Where a photoconductive compound and a binder resin are used, if the content of the photoconductive compound is small, the resulting sensitivity is low. Therefore, the content of the photoconductive compound is in the range of 0.05 to 1.2 parts by weight, preferably 0.1 to 1.0 parts by weight based on 1 part by weight of binder resin.

If the film thickness of the photoconductive layer is too small, it cannot be charged with surface potential necessary for development. On the contrary, if the film thickness of the photoconductive layer is too large, it is subject to lateral etching called side etch upon removal thereof, making it impossible to obtain an excellent printing plate. Thus, the film thickness of the photoconductive layer is in the range of 0.1 to 30 μm, preferably 0.5 to 10 μm.

The preparation of the electrophotographic printing plate precursor of the present invention can be accomplished by coating a photoconductive layer onto an electrically conductive substrate using conventional processes. Examples of methods for the preparation of a photoconductive layer include a method which comprises incorporating components of the photoconductive layer in the same layer and a .method which comprises incorporating an electric charge carrier-generating substance and an electric charge carrier-transporting substance in different layers. Either method can be used.

The coating solution of the photoconductive layer can be prepared by dissolving various components of the photoconductive layer in a appropriate solvent. Solvent-insoluble components such as pigments can be ground to a grain diameter of 0.1 to 5 μm using a ball mill, paint shaker, dinomill, attritor or the like, and then dispersed. The binding resin and other additives to be incorporated into the photoconductive layer can be added during or after dispersion of the pigment. The coating solution thus prepared can be coated onto a substrate using known methods such as rotary coating, blade coating, knife coating, reverse roll coating, dip coating, rod bar coating and spray coating, and then dried to obtain an electrophotographic printing plate precursor. Examples of solvents which can be used for the coating solution include halogenated hydrocarbons such as dichloromethane, dichloroethane and chloroform, alcohols such as methanol and ethanol, ketones such as acetone, methyl ethyl ketone and cyclohexanone, glycol ethers such as ethylene glycol monomethyl ether and 2-methoxyethyl acetate, ethers such as tetrahydrofuran and dioxane, and esters such as ethyl acetate and butyl acetate.

For the purpose of improving the flexibility and surface conditions of the coated photoconductive layer, the photoconductive layer of the present invention may optionally include a plasticizer, a surface active agent, a matting agent, and other various additives in addition to the photoconductive compound and binding resin as desired. These additives can be incorporated in the system in an amount such that they do not deteriorate the static properties and etchability of the photoconductive layer.

An intermediate layer can be optionally provided in the electrophotographic printing plate precursor of the present invention for the purpose of improving the adhesivity of the electroconductive substrate and the photoconductive layer and the electric properties, etchability and printing properties of the photoconductive layer.

Examples of materials which can be incorporated in such an intermediate layer include casein, polyvinyl alcohol, ethyl cellulose, phenolic resins, styrene-maleic anhydride resins, polyacrylic acids, monoethanolamine, diethanolamine, triethanolamine, tripropanolamine, triethanolamine, and the hydrochlorides, oxalates, and phosphates thereof, monoaminocarboxylic acids such as aminoacetic acid and alanine, oxyamino acids such as serine, threonine, and dihydroxyethyl glycine, sulfur-containing amino acids such as cysteine and cystine, monoaminodicarboxylic acids such as aspartic acid and glutamic acid, diaminomonocarboxylic acids such as lysine, amino acids containing an aromatic nucleus such as p-hydroxyphenyl glycine, phenylalanine and anthranilic acid, amino acids containing heterocyclic rings such as tryptophan and proline, aliphatic aminosulfonic acids such as sulfamic acid and cyclohexylsulfamic acid, (poly)aminopolyacetic acids such as ethylenediaminetetraacetic acid, nitrilotriacetic acid, iminodiacetic acid, hydroxyethyliminodiacetic acid, hydroxyethylenediaminetriacetic acid, ethylene-diaminediacetic acid, cyclohexanediaminetetraacetic acid, diethylenetriaminepentaacetic acid, and glycol ether diaminetetraacetic acid, and same compounds wherein acid groups are partially or entirely in the form of the salts thereof, such as the sodium salt, potassium salt, ammonium salt or the like.

An overcoat layer capable of being removed at the same time with the etching of the photoconductive layer can be optionally provided on the photoconductive layer for the purpose of improving the electrostatic properties, image properties upon toner development, the adhesion to toner or the like. The overcoat layer may be a mechanically matted layer or a resin layer containing a matt agent. Examples of suitable matt agents include silicon dioxide, zinc oxide, titanium oxide, zirconium oxide, glass grains, alumina, starch, resin grains (e.g., polymethyl methacrylate, polystyrene, phenolic resins), and matt agents as described in U.S. Pat. Nos. 2,701,245, and 2,992,101. Two or more of these matt agents can be used in combination, if desired.

The resin to be incorporated in the resin layer containing such a matt agent can be appropriately selected depending on the etching solution to be used in combination for the removal of the photoconductive layer. Specific examples of suitable resins include gum arabic, glue, gelatin, casein, celluloses (e.g., viscose, methyl cellulose, ethyl cellulose, hydroxyethyl cellulose, hydroxypropylmethyl cellulose, carboxymethyl cellulose), starches (e.g., soluble starch, modified starch), polyvinyl alcohol, polyethylene oxide, polyacrylic acid, polyacrylamide, polyvinyl methyl ether, epoxy resin, phenolic resins (particularly preferably, novolak phenolic resin), polyamides, and polyvinyl butyral. Two or more of these resins can be used in combination, if desired.

A printing plate can be prepared from the present electrophotographic printing plate precursor using any known method. Specifically, the electrophotographic printing plate precursor is essentially uniformly charged in the dark, and then imagewise exposed to light to form an electrostatic latent image thereon. Examples of suitable exposure processes include a scanning exposure with a semiconductor laser, He-Ne laser, or the like, a reflective imagewise exposure with a xenon lamp, tungsten lamp or fluorescent tube as a light source, and a close contact exposure through a transparent positive film.

The latent image thus formed is then developed with a toner. The development can be accomplished using known methods such as cascade develoment, magnetic brush development, powder cloud development and liquid development. Among these development processes, liquid development, which enables the formation of a fine image, is preferably used for the preparation of a printing plate. The toner image thus developed can be fixed using any known fixing process such as heating fixing, pressure fixing and. solvent fixing. With the toner image thus fixed as a resist, the photoconductive layer in the non-image portion is removed using an etching solution to obtain a printing plate.

Suitable etching solutions which can be used for the removal of a photoconductive insulating layer in the toner image portion after the formation of a toner image include any solvent capable of removing the photoconductive insulating layer. Such a solvent is not specifically limited. Preferably, an alkaline solvent can be used in the present invention. The term "alkaline solvent" as used herein means an aqueous solution containing an alkaline compound or an aqueous solution containing an alkaline compound and an organic solvent.

Examples of suitable alkaline compounds include organic and inorganic alkaline compounds such as sodium hydroxide, potassium hydroxide, sodium carbonate, sodium silicate, potassium silicate, sodium metasilicate, potassium metasilicate, sodium phosphate, potassium phosphate, ammonia, monoethanolamine, diethanolamine, triethanolamine and other aminoalcohols. As described above, water or any organic solvent can be used as a solvent for the etching solution. An etching solution comprising water as a main component is preferably used from the stand point of odor and environmental pollution.

The etching solution comprising water as a main component can optionally include various organic solvents. Preferred examples of suitable organic solvents include lower alcohols or aromatic alcohols such as methanol, ethanol, propanol, butanol, benzyl alcohol and phenethyl alcohol, ethylene glycol, diethylene glycol, triethylene glycol, polyethylene glycol, Cellosolve, and aminoalcohols such as monoethanolamine, diethanolamine and triethanolamine.

Furthermore, the etching solution can contain a surface active agent, an antifoaming agent, and optionally various additional additives.

In the present invention, the toner to be used for the formation of image portion is not specifically limited as long as it is resistant to the above described etching solution. In general, the toner to be used in the present invention preferably comprises a resin component resistant to the etching solution.

Examples of suitable resin components include acrylic resins comprising methacrylic acid, acrylic acid and ester thereof, vinyl acetate resins, copolymer resins such as a copolymer of vinyl acetate and ethylene or vinyl chloride, vinyl chloride resins, vinylidene chloride resins, vinyl acetal resins such as polyvinyl butyral, copolymer resins such as polystyrene, styrenebutadiene copolymer and methacrylic ester, polyethylene, polypropylene and chlorinated thereof, polyester resins (e.g., polyethylene terepthalate, polyethylene isophthalate, polycarbonate of bisphenol A), phenolic resins, xylene resins, alkyd resins, vinyl-modified alkyd resins, gelatin, cellulose ester derivatives such as carboxymethyl cellulose, waxes, and polyolefins.

The present invention is further described by reference to the following examples, but the present invention should not be construed as being limited thereto. Unless otherwise indicated herein, all parts, percents, ratios and the like are by weight.

EXAMPLE 1

The surface of an aluminum sheet according to JIS1050 was grained using a rotary nylon brush and an aqueous suspension of pumice as an abrasive. As a result, the surface roughness (average central line roughness) was 0.5 μm. After washing the aluminum sheet with water, the sheet was immersed in and etched with a 10% aqueous solution of sodium hydroxide at a temperature of 70° C. so that the dissolution of aluminum reached 6 g/m$^2$. After washing the aluminum sheet with water, the sheet was immersed in a 30% aqueous solution of nitric acid for 1 minute so that it was neutralized, and then thoroughly washed with water. The aluminum sheet was then subjected to electrolytic roughening in a 0.7% aqueous solution of nitric acid using a rectangular alternating waveform having an anodic voltage of 13 v and a cathodic voltage of 6 v (as described in JP-B-55-19191) for 20 seconds. The aluminum sheet was immersed in a 20% aqueous solution of nitric acid at a temperature of 50° C. so that the surface thereof was washed. The aluminum sheet was washed with water. The aluminum sheet was then subjected to anodic oxidation in a 20% aqueous solution of sulfuric acid so that the weight of the anodic oxide film formed was 3.0 g/m$^2$. The aluminum sheet was washed with water, and then dried to prepare a substrate.

Onto the substrate was coated the following photoconductive layer coating solution using a bar coater. The material was then dried at a temperature of 120° C. for 10 minutes to prepare an electrophotographic printing plate.

| Photoconductive Layer Coating Solution (1) | |
|---|---|
| ε-type Copper Phthalocyanine (Liophoton ERPC; Toyo Ink Mfg. Co., Ltd.) | 1.0 part |
| Copolymer of Benzyl Methacrylate and Methacrylic acid (methacrylic acid: 30 mol %) | 10.0 parts |
| Tetrahydrofuran | 48.0 parts |
| Cyclohexanone | 16.0 parts |

The above-described materials were charged into a 300-ml glass container with glass beads. The materials were then dispersed using a paint shaker (produced by Toyo Seiki Seisakusho K. K.) for 60 minutes to prepare a photoconductive layer dispersion as Coating Solution (1).

The electrophotographic printing plate precursor thus prepared had a dried film thickness of 4.0 μm.

A plurality of sheets of the electrophotographic printing plate precursor were stacked with a polyethylene-laminated paper (paper density: 50 g/m$^2$; polyethylene layer thickness: 10 μm) interposed therebetween with the polyethylene surface brought into contact with the light-sensitive layer. The stack was then cut with a guillotine cutter. The peripheral edge face of the stack was then coated with a water-soluble crayon as set forth below in an amount of about 2 g/m$^2$ on a solid basis.

Edge Face Treatment—1

Water-Soluble Crayon (black) Wachsmalkreiden 228M10D available from Staedtler Inc. (Germany).

The electrophotographic printing plate precursor sample thus prepared was then corona-charged at a surface potential of +350 V with a corona charger in the dark, exposed to light from a tungsten lamp through a negative image, and subjected to reversal development with a liquid developer comprising Isopar H (Esso Standard Inc.) as set forth below with a +250 v bias voltage applied to the opposing electrode. Thus, a sharp positive image was obtained. The printing plate precursor was then heated to a temperature of 140° C. for 5 minutes to fix the toner image. The material was then immersed in an etching solution obtained by diluting 40 parts of potassium silicate, 10 parts of potassium hydroxide and 100 parts of ethanol in 800 parts of water, thoroughly washed with water, and then coated with a gum solution (GU-7 for PS plate available from Fuji Photo Film Co., Ltd.) to prepare an offset printing plate. No water-soluble crayon or toner from the liquid developer was observed attached to the edge face of the material.

With this printing plate mounted in an offset printer, printing was carried out. All the prints thus obtained were quite free of stains eve on the portions corresponding to the edge of the printing plate.

| Liquid Developer | |
|---|---|
| p-Toluenesulfonate of Styrene/Vinyl Toluene/2-Ethylhexyl-methacylate/Trimethylammonium Ethyl Methacrylate(40/58/1/1 molar ratio) Copolymer (of the formula below) | 5 g/l |
| Iron Naphthenate | 0.3 g/l |
| Isopar H | 1 l |

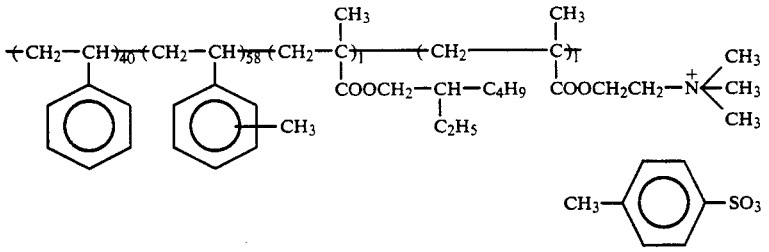

COMPARATIVE EXAMPLE 1

A printing plate was prepared in the same manner as in Example 1 except that the edge face of the printing plate precursor was not coated with the water-soluble crayon.

With this printing plate, printing was carried out in the same manner as in Example 1. The resulting prints had no stain on the image portions but had linear stains on the portion corresponding to the edge face of the printing plate.

EXAMPLE 2

An electrophotographic lithographic printing plate precursor was prepared in the same manner as in Example 1 except that a water-soluble colored pencil as set forth below was used instead of the water-soluble crayon. A printing plate was then prepared from the printing plate precursor in the same manner as in Example 1. Printing was then carried out in the same manner as in Example 1. All the prints thus obtained were quite free of stain even at the portions corresponding to the edge of the printing plate.

Edge Face Treatment—2

Water-soluble colored pencil (blue) (124 30) Karat Aquarelp available from Staedtrer Inc. (Germany)

EXAMPLE 3

An electrophotographic lithographic printing plate precursor was prepared in the same manner as in Example 1 except that a water-soluble colored pencil as set forth below was used instead of the water-soluble crayon. A printing plate was then prepared from the printing plate precursor in the same manner as in Example 1. Printing was then carried out in the same manner as in Example 1. All the prints thus obtained showed less stain than the comparative example on the portions corresponding to the edge of the printing plate.

Edge Face Treatment—3

Rakugaki Crayon (Disney Character DGW ①-16) (green) available from Pentel Inc. (Japan)

EXAMPLE 4

An electrophotographic lithographic printing plate precursor was prepared in the same manner as in Example 1 except that a water-soluble colored pencil as set forth below was used instead of the water-soluble crayon. A printing plate was then prepared from the printing plate precursor in the same manner as in Example 1. Printing was then carried out in the same manner as in Example 1. All the prints thus obtained were quite free of stain even at the portions corresponding to the edge of the printing plate.

| Edge Face Treatment-4 | |
|---|---|
| Ester Compound of the general Formula (I) (compound with an average molecular weight of 2,500 obtained by esterification of a higher aliphatic acid derived from a natural wax with a polyethylene glycol) | 88 parts |

-continued

| Edge Face Treatment-4 | |
|---|---|
| Phthalocyanine Blue | 12 parts |

The ester compound was charged into a planetary mixer, and then melted at a temperature of 100° C. The above described phthalocyanine blue pigment was added to the material. The mixture was stirred for 2 hours to obtain a uniform mixture. The material was then poured into a mold and molded.

EXAMPLE 5

An electrophotographic printing plate precursor was prepared in the same manner as in Example 1 except that a Photoconductive Layer Coating Solution (2) as set forth below was used instead of the Photoconductive Layer Coating Solution (1).

| Photoconductive Layer Coating Solution (2) | |
|---|---|
| Trisazo Compound (as set forth below) | 1.0 part |
| Oxazole Compound (as set forth below) | 2.5 parts |
| Copolymer of Vinyl Acetate and Crotonic Acid (Resyn No. 28-1310 available from Kanebo NSC Co., Ltd.) | 10 parts |
| Tetrahydrofuran | 100 parts |

The above described materials were charged into a 500-ml glass container containing glass beads. The materials were then dispersed in a paint shaker (produced by Toyo Seiki Seisakusho K. K.) for 60 minutes to prepare a photoconductive layer dispersion.

The photoconductive layer has a thickness of about 4 μm. The peripheral edge face of the printing plate precursor was coated with the same edge face treatment as used in Example 1 in the same manner as in Example 3.

The electrophotographic printing plate precursor sample thus prepared was then corona-charged at a surface potential of +400 V by a corona charger in the dark, exposed to light from a tungsten lamp through a negative image, and subjected to reversal development with the liquid developer as set forth in Example 1 (bias voltage: +300 v). Thus, a sharp positive image was obtained. The material was then heated at a temperature of 120° C. for 2 minutes to fix the toner image.

The material was then immersed in an etching solution obtained by diluting DN-3C (developer for a PS plate available from Fuji Photo Film Co., Ltd.) with water in a vol proportion of 1:2 for 10 seconds to etch the nonimage portions, thoroughly washed with water, and then coated with a gum solution (GU-7 for a PS plate available from Fuji Photo Film Co., Ltd.) to prepare an offset printing plate.

With this printing plate mounted in an offset printer, printing was carried out. All of the prints thus obtained were quite free of stain even at the portions corresponding to the edge of the printing plate.

EXAMPLES 6–9

The procedures of Example 5 were repeated except that the water-soluble black crayon was replaced by water-soluble crayons with other colors of the same make or water-soluble crayons of different makes. All the prints thus obtained were quite free of stain even at the portions corresponding to the edge of the printing plate.

EXAMPLE 6 Edge Face Treatment—5

Water-Soluble Crayon (yellow) Wachsmalkreiden 228M10D available from Staedtler Inc. (Germany)

EXAMPLE 7 Edge Face Treatment—6

Water-Soluble Crayon (blue) Wachsmalkreiden 228M10D available from Staedtler Inc. (Germany)

EXAMPLE 8 Edge Face Treatment—7

Water-Soluble Crayon (black) Neo Color-II Aquarelle available from Caran D'ache Inc. (Switzerland)

EXAMPLE 9 Edge Face Treatment—7

Water-Soluble Crayon (black) Cold Faber Aquawacks available from Faber Castell (Germany)

An electrophotographic lithographic printing plate precursor was prepared in the same manner as in Example 1 except that the water-soluble drawing material as set forth below was used instead of the water-soluble crayon. A printing plate was then prepared from the printing plate precursor in the same manner as in Example 1. Printing was then carried out in the same manner as in Example 1. All of the prints thus obtained were quite free of stain even at the portions corresponding to the edge of the printing plate.

| Edge Face Treatment-9 | |
|---|---|
| Japan Wax | 25 parts by weight |
| Paraffin Wax | 25 parts by weight |
| Sorbitan Monostearate (HLB: 4.7; Span 60 available from Kao Atras Co., Ltd.) | 10 parts by weight |
| Titanium Oxide | 5 parts by weight |

The above described components were melted at a temperature of 80° C. in a polypropylene container. 15 parts by weight of 80° C. hot water were gradually added to the material with stirring. 20 parts by weight of a 10 wt % aqueous solution of polyvinyl alcohol which had been heated to a temperature of 80° C. were gradually added to the material to obtain a W/O type emulsion solution. The emulsion solution was then poured into a mold to obtain a solid drawing material.

EXAMPLE 10

An electrophotographic lithographic printing plate precursor was prepared in the same manner as in Example 5 except that the water-soluble drawing material as set forth below was used instead of the water-soluble crayon. A printing plate was then prepared from the printing plate precursor in the same manner as in Example 1. Printing was then carried out in the same manner as in Example 1. All of the prints thus obtained were quite free of stain even at the portions corresponding to the edge of the printing plate.

| Edge Face Treatment-10 | |
|---|---|
| Organic Pigment (Seika Fast Red 116 available from Dainich Seikasei Co., Ltd.) | 15 parts by weight |
| Titanium Oxide | 5 parts by weight |
| Talc | 20 parts by weight |
| Stearyl Alcohol | 5 parts by weight |
| Polyoxyethylene Stearyl Ether | 20 parts by weight |
| Polyethylene Glycol #20000 (average molecular weight: | 20 parts by weight |

-continued

| Edge Face Treatment-10 |
|---|
| 20,000, available from Nippon Ois And Fats Co., Ltd.) |

Among these components, the powder components, i.e., the organic pigment, the titanium oxide and talc were uniformly dispersed in a mixer. Stearyl alcohol, polyoxyethylene stearyl ether, polyethylene glycol distearate and polyethylene glycol were dissolved at a temperature of 80° C. in a planetary mixer. The pigment mixture was then gradually added to the material in planetrary mixer. The material was stirred until it was homogenized. The resulting mixture was kneaded with a two-roll mill, and then poured into a mold to obtain a solid drawing material.

The electrophotographic lithographic printing plate precursor of the present invention provides a lithographic printing plate which achieves complete inhibition of print stain attributed to the contamination of the edge face of the printing plate with a toner upon reversal development to give high quality prints free of print stain at the portions corresponding to the edge of the printing plate.

While the invention has been described in detail and with respect to specific embodiments thereof, it will be apparent to one skilled in the art that various changes and modifications can be made therein without departing from the spirit and scope thereof.

What is claimed is:

1. An electrophotographic lithographic printing plate precursor comprising a photoconductive layer on an electrically conductive support having a hydrophilic surface thereon which is subjected to a process which comprises formation of a toner image on said photoconductive layer, and then removal of said photoconductive layer from nonimage portions other than said toner image portion to form a lithographic printing plate, wherein said electrophotographic lithographic printing plate precursor has been treated with a water-soluble or water-dispersible solid material at the edge face thereof.

2. An electrophotographic lithographic printing precursor as claimed in claim 1, wherein said edge face treatmetment is a water-soluble or water-dispersible solid drawing material.

3. An electrophotographic lithographic printing precursor as claimed in claim 1, wherein said edge face treatment is a water-soluble crayon.

4. An electrophotographic lithographic printing precursor as claimed in claim 1, wherein said edge face treatment is a water-soluble colored pencil.

5. An electrophotographic lithographic printing precursor as claimed in claim 1, wherein said edge face treatment is a water-soluble or water-dispersible chalk.

6. An electrophotographic lithographic printing precursor as claimed in claim 1, wherein said edge face treatment comprises a polyethylene glycol having a number average molecular weight of 1,000 or more.

7. An electrophotographic lithographic printing precursor as claimed in claim 1, wherein said edge face treatment comprises a monoesterified polyethylene glycol of the general formula (I) which is solid at ordinary temperature.

$$R-\underset{\underset{O}{\|}}{C}\leftarrow OCH_2CH_2\rightarrow_n OH \qquad (I)$$

wherein R represent a $C_{12-40}$ alkyl group; and an represents an integer of 4 to 50.

8. An electrophotographic lithographic printing precursor as claimed in claim 1, wherein said edge face treatment comprises a polyethylene glycol having a number average molecular weight of 1,000 or more and a nonionic surface active agent.

9. An electrophotographic lithographic printing precursor as claimed in claim 1, wherein said edge face treatment comprises a water-soluble component made of a water-soluble resin, an oil-soluble component made of a wax which is solid at ordinary temperature, and a surface active agent.

* * * * *